US011357270B2

(12) United States Patent
Abbott et al.

(10) Patent No.: US 11,357,270 B2
(45) **Date of Patent: *Jun. 14, 2022**

(54) UPPER AND LOWER TORSO GARMENTS HAVING AN IMPROVED BAND

(71) Applicant: HBI Branded Apparel Enterprises, LLC, Winston Salem, NC (US)

(72) Inventors: Michael D. Abbott, Statesville, NC (US); Roger D. Warren, Claremont, NC (US); Reginald L'Italien, New London, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 263 days.

This patent is subject to a terminal disclaimer.

(21) Appl. No.: 16/677,358

(22) Filed: Nov. 7, 2019

(65) Prior Publication Data

US 2020/0068959 A1 Mar. 5, 2020

Related U.S. Application Data

(60) Continuation of application No. 16/355,078, filed on Mar. 15, 2019, now Pat. No. 10,477,903, which is a (Continued)

(51) Int. Cl.
*A41C 3/12* (2006.01)
*A41B 9/02* (2006.01)
(Continued)

(52) U.S. Cl.
CPC ..... *A41C 3/12* (2013.01); *A41B 9/02* (2013.01); *A41B 9/04* (2013.01); *A41B 9/14* (2013.01);
(Continued)

(58) Field of Classification Search
CPC ..... A41C 3/12; A41C 1/12; A41C 3/0014; A41F 9/00; A41B 9/02; A41B 9/04;
(Continued)

(56) References Cited

U.S. PATENT DOCUMENTS 2,180,111 A 11/1939 Kapinas
2,971,514 A 2/1961 Steinmetz
(Continued)

FOREIGN PATENT DOCUMENTS

JP 2007131002 5/2007
JP 2007211369 8/2007

OTHER PUBLICATIONS

Second Chinese Office Action in Chinese Application No. 201680051329.8, dated Jan. 20, 2020, 22 pages with English translation.

(Continued)

*Primary Examiner* — Gloria M Hale
(74) *Attorney, Agent, or Firm* — Fish & Richardson P.C.

(57) ABSTRACT

A lower torso garment, such as a brief, includes a body having a pair of leg openings, a crotch portion between the leg openings, and a waist opening, and a waist band connected to the body and positioned at the waist opening. The waist band includes an elastomeric band affixed between overlapping plies of fabric, and the elastomeric band includes a thermoplastic elastomer film. The elastomeric band is positioned between the overlapping plies of fabric.

15 Claims, 8 Drawing Sheets

Related U.S. Application Data continuation of application No. 16/112,390, filed on Aug. 24, 2018, now Pat. No. 10,258,090, which is a division of application No. 14/845,181, filed on Sep. 3, 2015, now Pat. No. 10,117,469, which is a continuation-in-part of application No. 13/782,736, filed on Mar. 1, 2013, now Pat. No. 9,254,009.

(51) Int. Cl.

| | |
|---|---|
| ***A41B 9/04*** | (2006.01) |
| ***A41B 11/14*** | (2006.01) |
| ***A41C 1/12*** | (2006.01) |
| ***A41B 9/14*** | (2006.01) |
| ***A41F 9/00*** | (2006.01) |
| ***A41C 3/00*** | (2006.01) |
| ***D04B 1/24*** | (2006.01) |

(52) U.S. Cl.

CPC ..... *A41B 11/14* (2013.01); *A41C 1/12* (2013.01); *A41C 3/0014* (2013.01); *A41F 9/00* (2013.01); *D04B 1/243* (2013.01); *D04B 1/246* (2013.01); *A41B 2300/22* (2013.01); *A41B 2400/82* (2013.01); *A41B 2500/10* (2013.01); *A41B 2500/50* (2013.01); *D10B 2403/0241* (2013.01)

(58) Field of Classification Search

CPC ... A41B 9/14; A41B 2500/10; A41B 2400/82; A41B 2300/22; A41B 2500/50

See application file for complete search history.

(56) References Cited

U.S. PATENT DOCUMENTS

| | | | |
|---|---|---|---|
| 3,046,990 | A | 7/1962 | Dozier |
| 3,322,127 | A | 5/1967 | Sachs |
| 3,665,929 | A | 5/1972 | Brantly |
| 3,750,193 | A | 8/1973 | Cooke |
| 3,779,250 | A | 12/1973 | Radomski |
| 3,813,698 | A | 6/1974 | Campbell, Sr. et al. |
| 3,843,973 | A | 10/1974 | Dillenburger |
| 3,848,266 | A | 11/1974 | Conaway et al. |
| 3,987,496 | A | 10/1976 | Bernard |
| 4,089,068 | A | 5/1978 | Swallow |
| 4,324,254 | A | 4/1982 | Freedman et al. |
| 4,332,034 | A | 6/1982 | Muse |
| 4,549,317 | A | 10/1985 | D'Ambrosio |
| 4,596,055 | A | 6/1986 | Aach et al. |
| 4,771,483 | A | 9/1988 | Hooreman et al. |
| 4,781,651 | A | 11/1988 | Ekins |
| 4,816,005 | A | 3/1989 | Braaten |
| 4,970,728 | A | 11/1990 | D'Ambrosio |
| 5,037,348 | A | 8/1991 | Farino |
| 5,119,511 | A | 6/1992 | Packer et al. |
| 5,168,581 | A | 12/1992 | Garcia et al. |
| 5,211,598 | A | 5/1993 | Hall |
| 5,215,494 | A | 6/1993 | Flanagan |
| 5,359,732 | A | 11/1994 | Waldman et al. |
| 5,398,346 | A | 3/1995 | Feinberg |
| 5,483,702 | A | 1/1996 | D'Ambrosio |
| 5,533,458 | A | 7/1996 | Bergland et al. |
| 5,572,888 | A | 11/1996 | Browder, Jr. |
| 5,746,068 | A | 5/1998 | Popa et al. |
| 5,802,619 | A | 9/1998 | Ralston et al. |
| 5,963,988 | A | 10/1999 | Jackson, Jr. |
| 6,138,282 | A | 10/2000 | Follese |
| 6,178,784 | B1 | 1/2001 | Marley, Jr. |
| 6,276,175 | B1 | 8/2001 | Browder, Jr. |
| 6,311,333 | B1 | 11/2001 | Batra |
| 6,622,312 | B2 | 9/2003 | Rabinowicz |
| 7,396,274 | B2 | 7/2008 | Wiegmann |
| 7,735,448 | B2 | 6/2010 | Rahimi |
| 7,927,180 | B2 | 4/2011 | Simpson |
| 9,254,009 | B2 * | 2/2016 | Abbott ..... A41B 9/02 |
| 10,117,469 | B2 * | 11/2018 | Abbott ..... A41C 3/0014 |
| 10,258,090 | B2 * | 4/2019 | Abbott ..... A41B 11/14 |
| 10,477,903 | B2 * | 11/2019 | Abbott ..... A41F 9/00 |
| 2002/0022433 | A1 | 2/2002 | Yeung et al. |
| 2002/0129434 | A1 | 9/2002 | Rabinowicz |
| 2002/0152775 | A1 | 10/2002 | Bowder |
| 2003/0192351 | A1 | 10/2003 | Meckley |
| 2003/0196252 | A1 | 10/2003 | Blakely |
| 2003/0230120 | A1 | 12/2003 | Mitchell et al. |
| 2004/0014394 | A1 | 1/2004 | Mitchell et al. |
| 2004/0198178 | A1 | 10/2004 | Mitchell et al. |
| 2006/0021388 | A1 | 2/2006 | Mitchell et al. |
| 2006/0277948 | A1 | 12/2006 | Sorensen |
| 2007/0032771 | A1 | 2/2007 | Abed et al. |
| 2007/0251636 | A1 | 11/2007 | Herbert |
| 2012/0052769 | A1 | 3/2012 | Pearce et al. |
| 2014/0041120 | A1 | 2/2014 | Li |
| 2014/0248822 | A1 | 9/2014 | Abbott et al. |
| 2014/0257219 | A1 * | 9/2014 | Neton ..... A61F 13/51401 604/365 |
| 2014/0259304 | A1 | 9/2014 | Mitchell et al. |
| 2015/0093537 | A1 | 4/2015 | Cain |
| 2016/0168345 | A1 * | 6/2016 | Eschenbacher ..... B32B 27/08 428/220 |
| 2018/0360136 | A1 | 12/2018 | Abbott et al. |
| 2019/0208835 | A1 | 7/2019 | Abbott et al. |

OTHER PUBLICATIONS

Canadian Office Action in Canadian Application No. 2,996,171, dated Feb. 5, 2020, 4 pages.

Japanese Office Action in JP Appln. No. 2018512123, dated Oct. 1, 2020, 12 pages with English Translation.

Korean Notice of Allowance in KR Appln. No. 10-2015-7026842, dated Nov. 11, 2020, 11 page with English Translation.

Australian Examination Report No. 2 in AU Appln. No. 2016315456, dated Mar. 12, 2021, 6 pages.

Russian Office Action in Russian Application No. 2018107683, dated Nov. 20, 2019, 11 pages with English Translation.

Australian Office Action in AU Appl. No. 2016315456, dated Oct. 15, 2020, 7 pages.

Brazilian Office Action in BR Appl. No. BR112018003912-8, dated Jun. 9, 2020, 4 pages.

Indian First Examination Report in IN Appln. No. 201817005253, dated Oct. 29, 2021, 7 pages with English Translation.

Japanese Decision of Refusal in JP Appln. No. 2018-512123, dated Oct. 7, 2021, 10 pages with English Translation.

* cited by examiner

UPPER AND LOWER TORSO GARMENTS HAVING AN IMPROVED BAND

CROSS-REFERENCE TO RELATED APPLICATIONS

This application is a continuation of and claims the benefit of priority to U.S. application Ser. No. 16/355,078, filed on Mar. 15, 2019 and now issued as U.S. Pat. No. 10,477,903, which is a continuation of U.S. application Ser. No. 16/112,390, now issued as U.S. Pat. No. 10,258,090 on Apr. 16, 2019, which is a divisional application of U.S. application Ser. No. 14/845,181, now issued as U.S. Pat. No. 10,117,469 on Nov. 6, 2018, which is a continuation-in-part of U.S. application Ser. No. 13/782,736, now issued as U.S. Pat. No. 9,254,009 on Feb. 9, 2016, the contents of which are hereby incorporated by reference.

TECHNICAL FIELD

This disclosure relates to circularly knitted upper and lower torso garments, such as a brassiere or brief. More particularly, the present disclosure relates to a circularly knitted brassiere and a lower torso undergarment having an improved chest band and waist band, respectively, affixed between the overlapping plies of fabric.

BACKGROUND

Upper torso garments, such as, brassieres generally and sports bras in particular have a torso encircling band that is knitted at or attached to the lower edge of the brassiere to provide stability and additional support to the wearer. Such bands also are knitted at or attached to the upper edge of lower torso undergarments, such as briefs, to function as a waist band. One known way to form a chest band or waist band is to knit a turned welt during the process of knitting the fabric tube. An alternative method is to stitch an elastomeric band to the bottom edge of the brassiere, or the top edge of the brief, around the entire periphery; this additional step requires additional labor and increases costs. The resulting band tends to be relatively bulky and thick, and, therefore more visible and less comfortable when worn.

SUMMARY

An aspect of the present disclosure is a circularly knitted garment, such as a brassiere or brief, having a thin elastomeric band affixed between overlapping plies of knitted fabric. In one exemplary embodiment, the elastomeric band comprises a thin polyamide film having a modulus (kilograms of holding power) that is greater than can be achieved by conventional elastomeric yarns, such as spandex and Lycra®. The modulus of the plies and film combined may be between about 1.0 kg and 4 kg. As used herein, the term "modulus" refers to the kilograms of recovery force available in the material at a given percentage of stretch. The greater the modulus, the stiffer the material, i.e. the more resistant the material will be to linear stretch. Depending upon the type of elastomeric material, its width and thickness, its modulus may vary widely.

Another aspect of the present disclosure is a method of forming a brassiere or lower torso undergarment having an elastomeric band affixed between the overlapping plies of fabric. The method comprises circularly knitting a body that is symmetrically dimensioned for forming a two-ply garment, comprising inner and outer layers when folded about a central fold line. The elastomeric band is positioned proximate the fold line and the plies are symmetrically overlapped about the fold line, thus enclosing the elastomeric band and forming the two-ply garment with a torso band that is thinner and, therefore, less visible and more comfortable when worn. In one embodiment, the elastomeric band is affixed to one or both of the inner and outer layers of knitted fabric by the application of temperature and pressure for a selected amount of time.

BRIEF DESCRIPTION OF THE DRAWINGS

The present disclosure will be more apparent from the following detailed explanation of embodiments of the disclosure in connection with the accompanying drawings.

DETAILED DESCRIPTION

One aspect of the present disclosure is directed to an upper torso garment, such as, a brassiere, a sports bra or a camisole. Referring to FIGS. 1-6 in general, a circularly-knitted brassiere is shown generally as 100. The circularly-knitted brassiere 100, which is formed on a conventional circular knitting machine, may comprise a two-ply brassiere body having overlapping inner 112 and outer 114 layers, or plies. While a two-ply brassiere is illustrated and described herein, the disclosure is not limited to a two-ply garment; rather, one-ply garments, such as brassieres and lower torso undergarments, are within the scope of the disclosure.

The brassiere body may be formed of any of the conventional materials such as polyester, nylon, etc. The body may be formed by also knitting in one or more elastomeric yarns, such as spandex, having some degree of elasticity for securing the garment about the wearer's torso. Each ply of fabric for the embodiments described herein may be between about 0.6 mm and about 2.0 mm thick.

Figure 1:
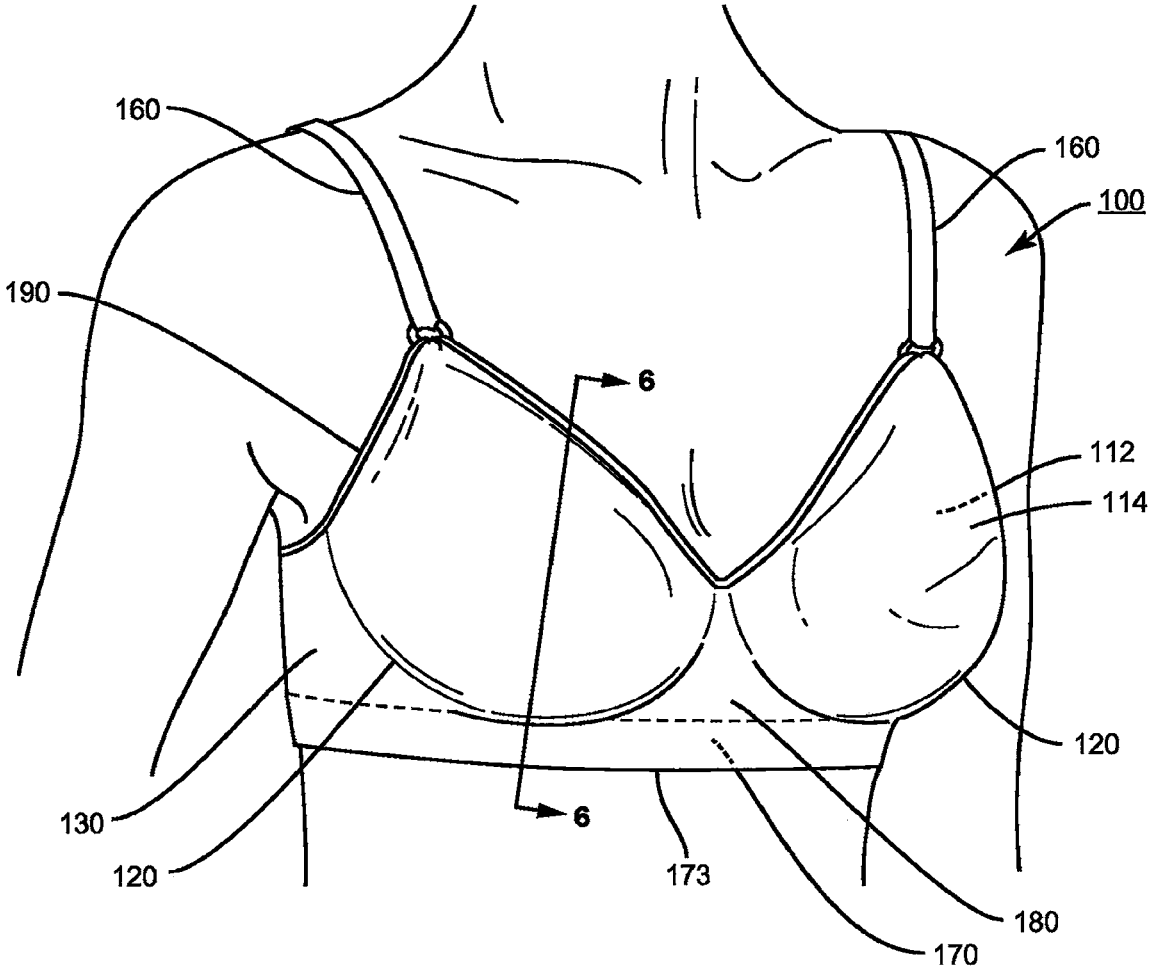
FIG. 1 is a front perspective environmental view of an example brassiere.
Figure 2:
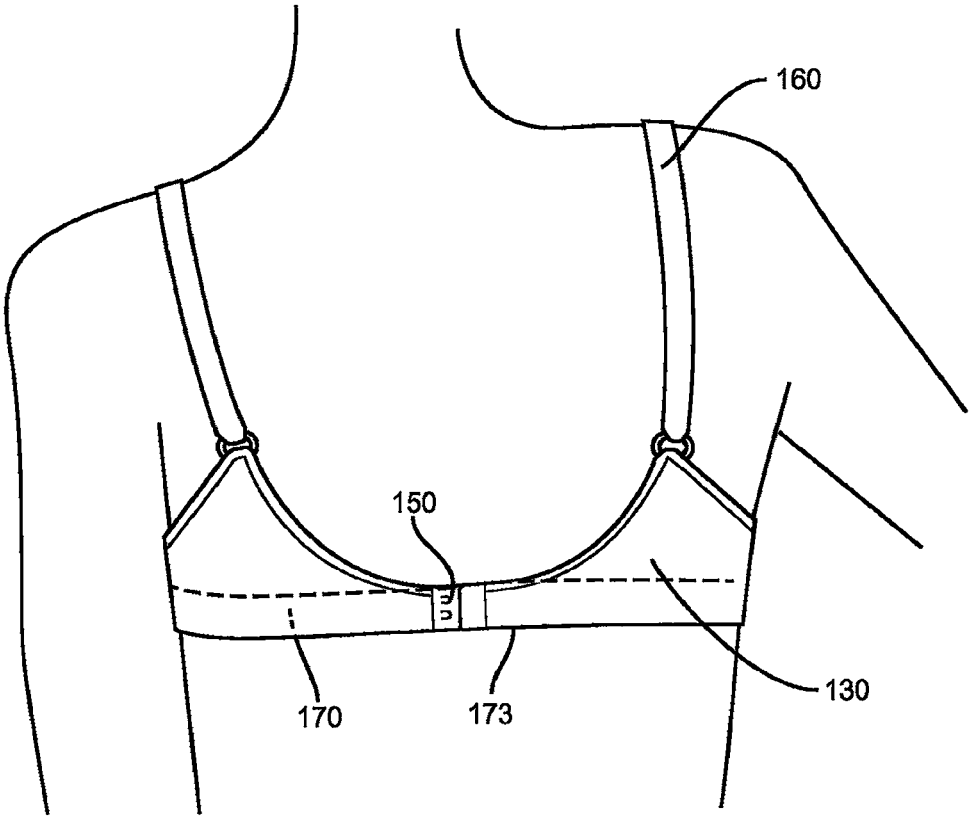
FIG. 2 is a rear perspective environmental view of the example brassiere of FIG. 1, illustrating an embodiment having a rear closure.
Figure 3:
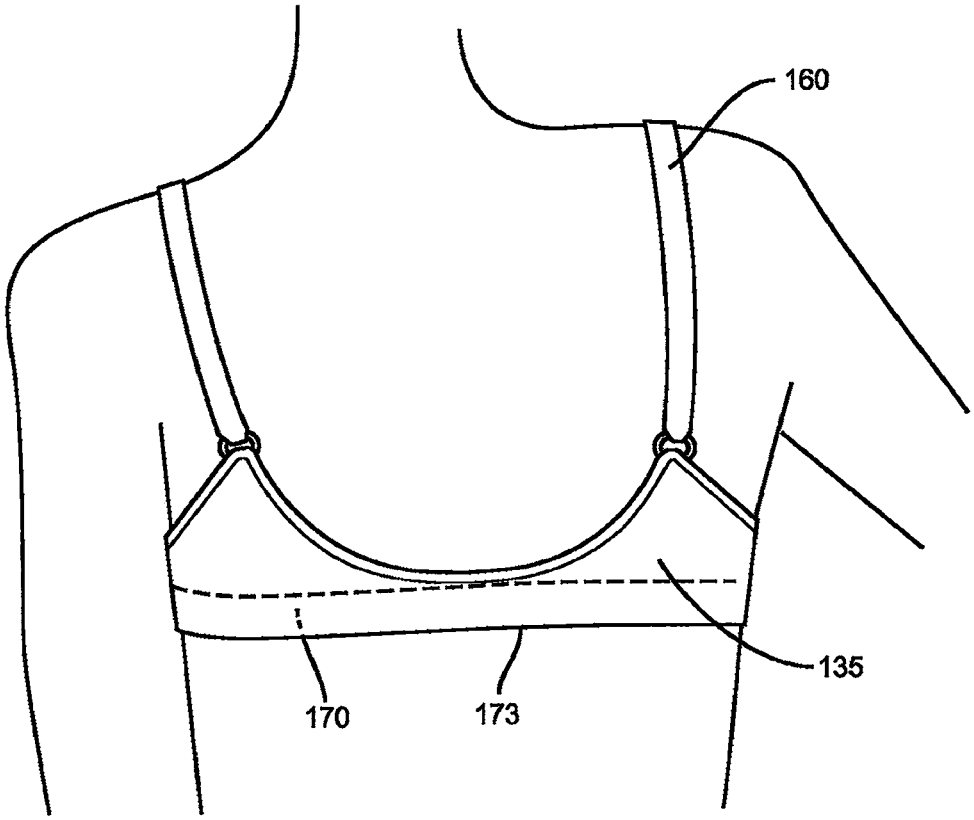
FIG. 3 is a rear perspective environmental view of the example brassiere of FIG. 1, illustrating a sports-type bra embodiment without a rear closure.
Figure 4:
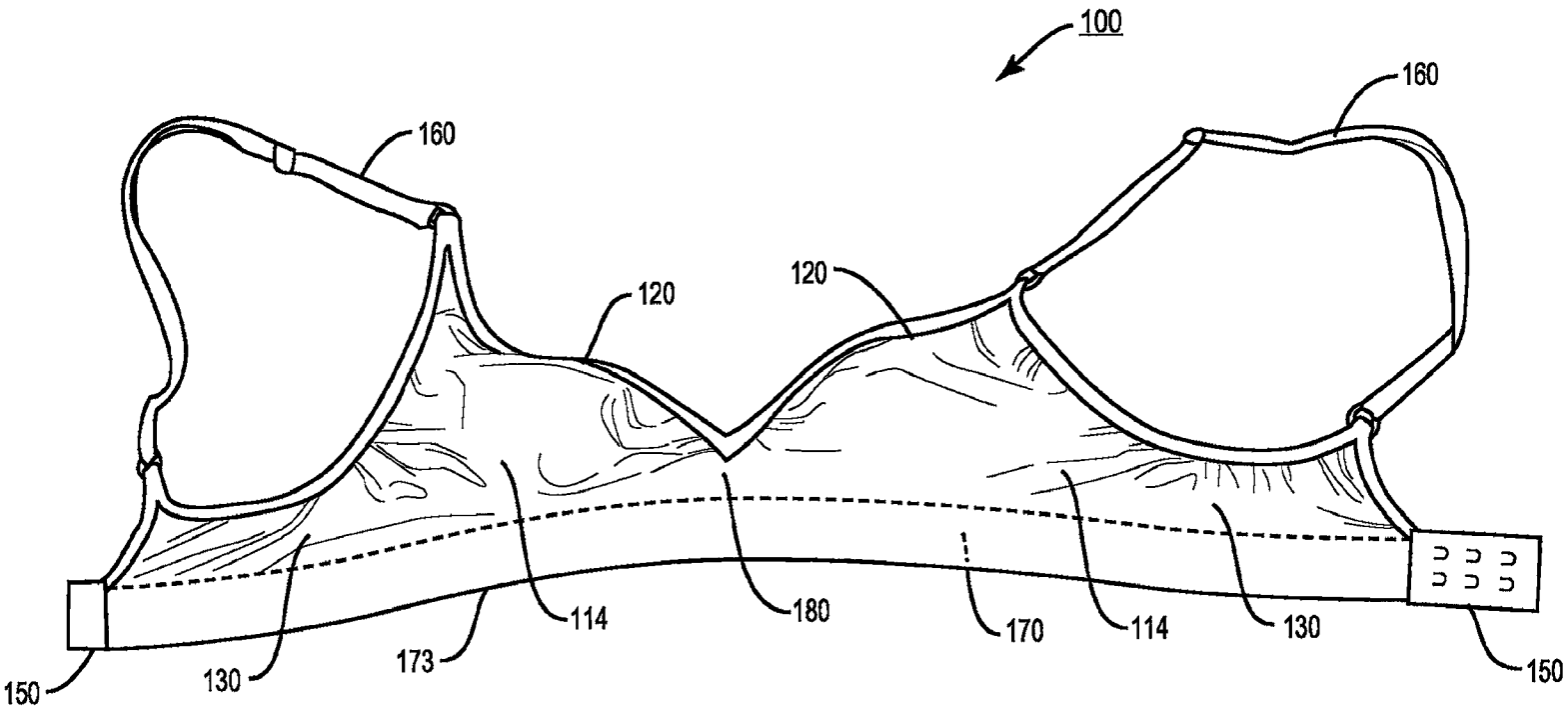
FIG. 4 is a front view of the example brassiere of FIGS. 1 and 2.
Figure 5:
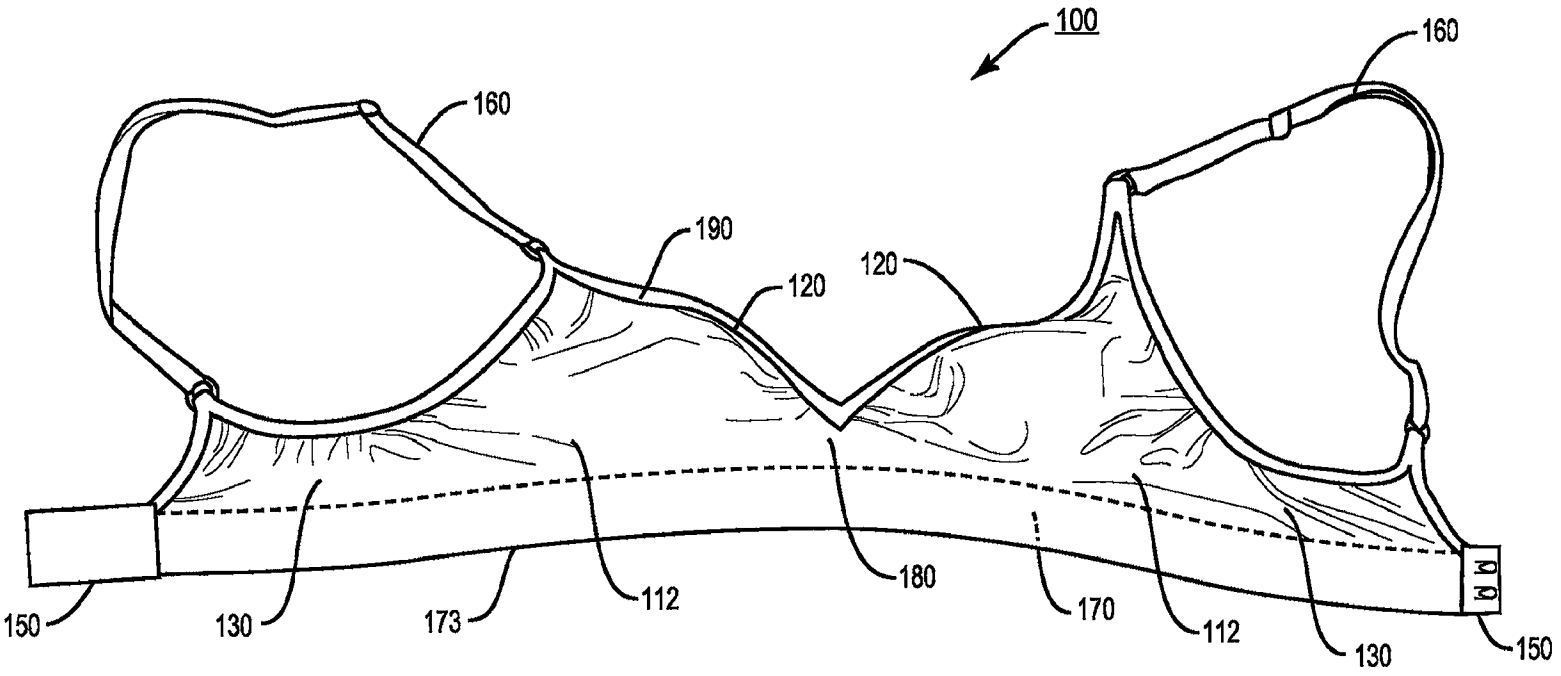
FIG. 5 is a rear view of the example brassiere of FIGS. 1 and 2.

As shown in FIGS. 2, 4 and 5, the brassiere disclosed herein comprises a pair of breast cups 120, and a torso encircling strap 130 extending outwardly from the outer edges of each breast cup 120, with the two torso straps 130 fastening at the back of the wearer with fasteners 150. In the exemplary embodiment shown in FIG. 3, a single continuous torso strap 135 extends between the outer edges of the breast cups 120 to encircle the torso of the wearer. This embodiment is typical of a pullover sports-type brassiere. Further, the breast cups 120 may be either molded after the brassiere body is formed, or may be knitted in as loose areas on the front of the body during the knitting process.

As shown in FIGS. 1-6, an elastomeric band 170 is inserted along the bottom of the brassiere 100, between the inner 112 and outer 114 plies, and extends beneath the breast cups 120, the central gore 180, and along the lower edges of the torso straps 130, 135.

Figure 6:
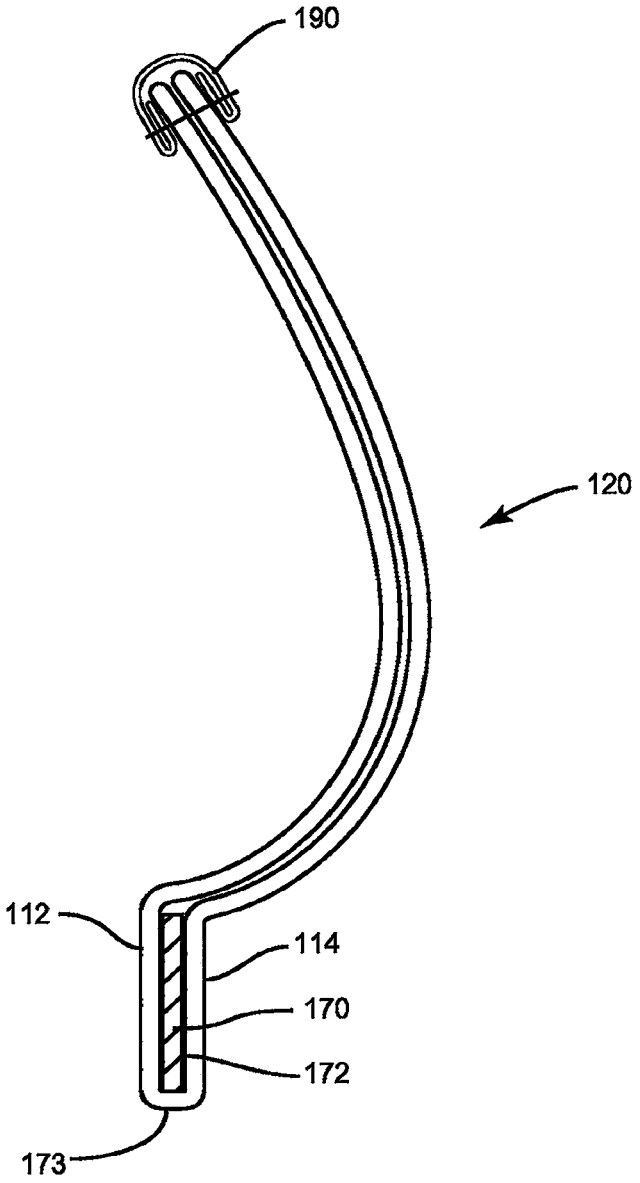
FIG. 6 is a cross-sectional view of the example brassiere of FIG. 1, taken along Line 6-6.

Turning now to FIG. 6, the elastomeric band 170 of the brassiere 100 comprises a relatively thin elastomeric material having an improved modulus and that maintains a relatively consistent modulus across a useful range of elongation. Depending upon the type and style of the brassiere 100, the thickness of the elastomeric band 170 may range from between about 0.010 mm and 0.45 mm to reduce the visibility of the elastomeric material when the garment is worn. The optimal thickness of the elastomeric band 170 will depend on the desired level of control to be provided for the brassiere 100, which is typically size dependent. As will be appreciated, the thinner the elastomeric band 170, the less visible the band when worn. The degree of control and support for the brassiere 100 type and style also depends on the width of the elastomeric band 170. The width of the elastomeric band 170 can range from about one-quarter (¼) inch for a minimally supporting bra up to seven (7) or more inches wide for a lower torso control garment. An optimal width for the exemplary embodiments illustrated herein is between about three-quarters (¾) inch and one and one-quarter (1¼) inches.

In one embodiment, the elastomeric band 170 comprises a thin film of thermoplastic elastomer (TPE). In another embodiment, the elastomeric band 170 comprises a woven or nonwoven material of filaments and/or fibers of thermoplastic elastomer (TPE). In certain instances, the elastomeric band includes multiple plies of material, with at least one of the plies being TPE. The thermoplastic elastomer may comprise a polyamide blend. One such polyamide blend is available under the trademark Pebax® from Arkema Inc. of King of Prussia, Pa. Other thin elastomeric materials, including other films, having the physical properties described below, may be suitable to form the elastomeric band 170. For example, the thermoplastic elastomer (TPE) can include styrene-based block copolymers, and/or thermoplastic urethane (TPU). One such styrenic block copolymer is SBC by Kraton®, as shown in Table 1 below. In some examples, the TPE can include styrene ethylene butadiene styrene (SEBS) block copolymers, styrene ethylene propylene (SEP) block copolymers, styrene isoprene styrene (SIS), styrene ethylene ethylene propylene styrene (SEEPS) block copolymers, styrene ethylene propylene styrene (SEPS) block copolymers, combinations of the foregoing block copolymers, and/or other styrenic block copolymers. In certain implementations, the elastomeric band 170 includes thermoplastic elastomeric fibers integral to the band 170.

In some implementations, the elastomeric band 170 has elastic recovery properties described below following test methods and procedures, for example, according to ASTM D4964. This test method includes constant rate of extension testing (i.e., stretch-strain testing). For example, elastomeric properties of the elastomeric band 170 can include a substantially zero hysteresis loss, where the elastomeric band 170 has an elasticity that is substantially maintained between a stretched state and an unstretched state of the band 170. In other words, a return percentage (e.g., stretch-back) of the elastomeric band 170 after stretch is at least about 98%, for example, up to about 99.9%. In certain implementations, the elastic band 170 can withstand at least 25 launderability cycles (e.g., washing and drying cycles) while retaining a percentage retention (e.g., 95% stretch retention). In some instances, the elastic band 170 is resistant to ultraviolet light and nitrous oxide (NO) gas degradation (e.g., discoloration, negative elastomeric effects, and/or other). In certain implementations, desired elastic film characteristics of the elastomeric band 170 can be achieved through adjustment of certain polymer ratios, and the addition of process oils, thermosetting resins, tackifier resins, anti-shrink agents, pigments, and/or other chemistry agents.

An example testing method (the "Stretch Back Indicator Test") for determining a stretch-back of the elastomeric band 170 includes a length of 1-inch-wide elastomeric band 170 held on each longitudinal end. The band is stretched to a length 150% of the initial unstretched length, for example, on a Zwick testing machine. After reaching the stretched length, the band is immediately returned to an unstretched state (e.g., without holding at stretched length). After cycling the band through two exercises of three cycles, a final unstretched length is determined every third cycle and compared to the initial unstretched length of the band. After the test is performed through the two exercises of three cycles for each sample, an indication of stretch-back (i.e., elastic recovery) is determined (e.g., by machine output) for the band by dividing the initial unstretched length over the final unstretched length and multiplying by 100 to obtain a percentage. The closer the final result is to 100%, the better the stretch back properties.

By way of example and comparison, for the exemplary embodiments shown herein, a typical knitted-in torso band, e.g., a turned welt, would be approximately 2.0 mm thick. A cut and sew brassiere with a sewn in elastic band of similar weight to the turned welt would be approximately 1.8 mm thick. For example, a band having the thermoplastic elastomeric polyamide film described above can be approximately 1.5 mm thick.

The modulus of the elastomeric material depends on its type of material, width and thickness. In the exemplary embodiments described herein, an optimal modulus may be between about 1.0 and 4.0 kilograms. As shown in the several examples in Table 1 below, this range in the modulus corresponds to between about 95% and 140% in deformation (stretch) when the elastomeric band 170 is subjected to a length direction static load of 7 kilograms.

TABLE 1

| Elastomeric Band Material | Thickness of Elastomeric Band | Modulus (kg) (40% elongation) (band plus plies) | Modulus (kg) (60% elongation) (band plus plies) | Total Percent Deformation (band plus plies) |
|---|---|---|---|---|
| Pebax ® | 0.10 mm | 1.08 | 1.66 | 132% |
| Pebax ® | 0.15 mm | 1.59 | 2.25 | 123% |
| SBC by Kraton ® | 0.30 mm | 2.31 | 3.50 | 102% |

By way of comparison, the body of brassiere 100 will have a modulus of less than 1 kilogram. For example, the two overlapped plies, formed from a conventional blend of 89% weight nylon and 11% weight spandex has a modulus of about 0.132 kg at 40% elongation and about 0.35 kg at 60% elongation. As seen in Table 1 above, the elastomeric bands provide a reduced increase in modulus with increased elongation. This produces a brassiere 100 that will be comfortable over a larger range of sizes. In the torso band region at the bottom of the brassiere proximate the fold line 173, the two-ply body material alone would allow for elongation of 160% when tested under the same 7 kg load as the samples in Table 1.

Referring again to FIG. 6, the method of forming the brassiere 100 of the present disclosure is best illustrated. The brassiere body or blank is knitted in the form of a tube on a conventional circular knitting machine. The center periphery of the tube corresponds to the fold line 173 about which the inner 112 and outer 114 layers will be overlapped into the two-ply brassiere body.

The elastomeric band 170 is positioned proximate the center fold line 173 on what will become the inner surfaces of the two-ply brassiere body when the tube is folded. The elastomeric band 170 may be coated on one or both sides with a heat-sealable adhesive 172 for adhering the elastomeric band 170 in position once the brassiere construction is complete. One suitable heat-sealable adhesive 172 is RX 2641, available from Bixby International Corp. of Newburyport, Mass. The disclosure, however, is not limited to using a heat-sealable adhesive to adhere the band 170; rather, the use of other suitable materials and methods for securing the band to the garment are within the scope of the disclosure.

The inner 112 and outer 114 layers of the brassiere body are next symmetrically overlapped about the fold line 173, enclosing the elastomeric band 170 and forming the two-ply brassiere body as described above. Where a heat-sealable adhesive 172 is applied to one or both sides of the elastomeric band 170, the elastomeric band 170 is affixed between the two plies with an air-operated press having upper and lower heating elements. An application temperature may be between about 150 degrees Fahrenheit and 380 degrees Fahrenheit, preferable about 320 degrees Fahrenheit. The application pressure should be no less than about 10 psi and no more than about 120 psi, preferably between about 30 and about 60 psi. The preferred pressure should be applied for no less than about 5 seconds and no more than about 90 seconds, preferably between about 20 and about 30 seconds. In certain implementations, the elastomeric band 170 can be applied to fabric layers without the heat-sealable adhesive 172. For example, the elastomeric band 170 can have melt properties allowing the elastomeric band 170 to fuse (e.g., heat-set, melt, and/or otherwise affix) to a fabric layer with an applied heat of between about 300 degrees Fahrenheit and about 360 degrees Fahrenheit. Alternatively, the elastomeric band 170 can have melt properties allowing the elastomeric band 170 to fuse (e.g., heat-set, melt, and/or otherwise affix) to a fabric layer with an applied heat of between about 300 degrees Fahrenheit and about 340 degrees Fahrenheit. As yet another alternative, the elastomeric band 170 can have melt properties allowing the elastomeric band 170 to fuse (e.g., heat-set, melt, and/or otherwise affix) to a fabric layer with an applied heat of between about 320 degrees Fahrenheit and about 340 degrees Fahrenheit. (e.g., at about 300, 305, 310, 315, 320, 325, 330, 335 or 340 degrees Fahrenheit).

Once the elastomeric band 170 is adhered between the inner 112 and outer 114 layers, the brassiere body may be cut to the desired shape. Subsequently, trim 190 is applied along the free edges, shoulder straps 160 attached, and fasteners 150 are affixed to complete the brassiere 100 construction. Where shoulder strap portions 160 are formed and cut with the brassiere body, they need only to be seamed together proximate the top of the shoulder. Similarly, where the torso strap 135 is continuous, no fasteners 150 are necessary.

Figure 7:
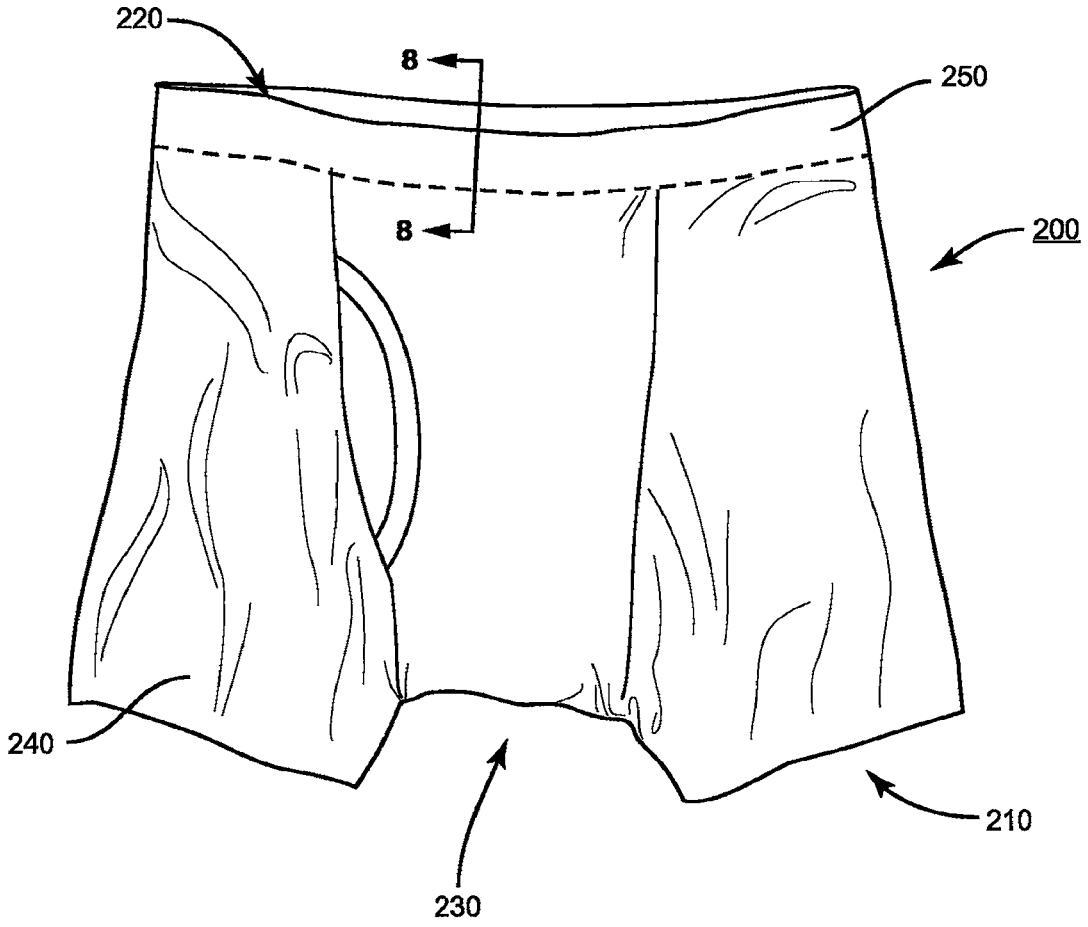
FIG. 7 is a front perspective environmental view of example boxer briefs.
Figure 8:
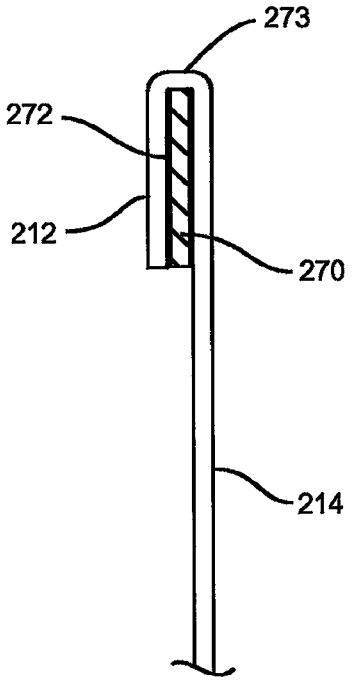
FIG. 8 is a cross-sectional view of the example boxer briefs of FIG. 7, taken along line 8-8.

Another aspect of the present disclosure is directed to a circularly-knitted lower torso undergarment, such as a boxer, a brief, a boxer brief, panties, pantyhose or shapewear. Referring to FIGS. 7 and 8, a boxer brief is shown generally as 200. The circularly-knitted brief 200, which is formed on a conventional circular knitting machine, comprises a body formed of any of the conventional materials such as polyester, nylon, etc. The body may be formed by also knitting in one or more elastomeric yarns, such as spandex, having some degree of elasticity for securing the garment about the wearer's lower torso.

The briefs 200 of the present disclosure comprises a pair of leg openings 210, a crotch portion 230 and a waist opening 220 surrounded by a waist band 250 of the present disclosure. The embodiment illustrated includes leg portions 240 as is typical of boxer style briefs. Conventional briefs, i.e. without leg portions 240, for males or females having the waist band 250 are also within the scope of the disclosure.

As best seen in FIG. 8, an elastomeric band 270, as described above, is inserted along the waist opening 220 of the brief 200, between inner 212 and outer 214 plies. Both the inner and outer plies 212, 214 are formed as parts of a single tube created by a circular knitting machine. The top portion of the tube is then folded downward along a top fold line 273 to form the waist band 250 having two plies, the elastomeric band 270 disposed adjacent to the fold line 273 and covered by the two plies. The elastomeric band 270, inner ply 212 and outer ply 214 may be held in place by adhesive 272, set using heat and pressure similar to the method discussed above. Alternate methods of adhering the elastomeric band to the body of the brief 200 are within the scope of the present disclosure.

It should be understood that the foregoing descriptions and examples are only illustrative of the disclosure. Various alternatives and modifications thereof can be devised by those skilled in the art without departing from the spirit and scope of the present disclosure. Accordingly, the present disclosure is intended to embrace all such alternatives, modifications, and variations.

We claim:

1. A lower torso garment, comprising:

a body comprising a pair of leg openings, a crotch portion between the leg openings and a waist opening;

a waist band connected to the body and positioned at the waist opening, the waist band comprising an elastomeric band affixed between overlapping plies of fabric; and the elastomeric band comprising a thermoplastic elastomer film and positioned between the overlapping plies of fabric, and the thermoplastic elastomer film comprises a styrenic block copolymer comprising at least one of a styrene ethylene butadiene styrene (SEBS) block copolymer, a styrene ethylene propylene styrene (SEPS) block copolymer, or a styrene ethylene propylene (SEP) block copolymer.

2. The lower torso garment of claim 1, wherein the thermoplastic elastomer film has a modulus that is greater than a modulus of the body.

3. The lower torso garment of claim 1, wherein a stretch back indicator percentage of the elastomeric band is greater than 98% after using the stretch back indicator test.

4. The lower torso garment of claim 1, wherein the elastomeric band is coated on at least one side for adhesively affixing the elastomeric band to at least one inner surface of the overlapping plies of fabric.

5. The lower torso garment of claim 1, wherein the garment is a boxer, a brief, a boxer brief, panties, pantyhose or shapewear.

6. The lower torso garment of claim 1, wherein the elastomeric band comprises a thickness between about 0.010 mm and about 0.45 mm.

7. The lower torso garment of claim 6, wherein the elastomeric band comprises a thickness between about 0.1 mm and about 0.3 mm.

8. The lower torso garment of claim 1, wherein a modulus of the elastomeric band including the overlapping plies of fabric is between about 1.0 and about 4.0 kilograms at 60% elongation.

9. The lower torso garment of claim 8, wherein the modulus is between about 1.0 and about 4.0 kilograms after being cycled with a maximum load of 7 kilograms according to ASTM D4964.

10. The lower torso garment of claim 1, where the overlapping plies of fabric overlap along an upper fold line.

11. The lower torso garment of claim 10, where the elastomeric band is positioned between the overlapping plies of fabric proximate the upper fold line.

12. The lower torso garment of claim 1, wherein the elastomeric band is resistant to at least one of ultraviolet light degradation or nitrous oxide gas degradation.

13. The lower torso garment of claim 1, wherein a stretch back indicator percentage of the elastomeric band is greater than 98% according to the stretch back indicator test.

14. A method of forming a lower torso garment, the method comprising:

knitting a body comprising a pair of leg openings, a crotch portion between the leg openings, and a waist opening;

selecting an elastomeric band comprising a thermoplastic elastomer film, wherein the thermoplastic elastomer film comprises a styrenic block copolymer comprising at least one of a styrene ethylene butadiene styrene (SEBS) block copolymer, a styrene ethylene propylene styrene (SEPS) block copolymer, or a styrene ethylene propylene (SEP) block copolymer;

surrounding the elastomeric band with overlapping plies of fabric forming a waist band; and connecting the waist band to the body, the waist band positioned at the waist opening.

15. The method of claim 14, comprising coating on at least one side of the elastomeric band an adhesive for affixing the elastomeric band to at least one inner surface of the overlapping plies of fabric of the waist band.

* * * * *